US007507919B2

(12) United States Patent
Sugahara et al.

(10) Patent No.: US 7,507,919 B2
(45) Date of Patent: Mar. 24, 2009

(54) MULTI-DIRECTIONAL INPUT DEVICE

(75) Inventors: Jun Sugahara, Okayama (JP); Seiki Miura, Okayama (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/099,336

(22) Filed: Apr. 8, 2008

(65) Prior Publication Data

US 2008/0251371 A1 Oct. 16, 2008

(51) Int. Cl.
*H01H 25/04* (2006.01)

(52) U.S. Cl. ..... 200/6 A

(58) Field of Classification Search ..... 200/4, 200/5 R, 6 A, 17 R, 18, 14; 341/20, 35; 345/156, 345/157, 161, 184
See application file for complete search history.

(56) References Cited

U.S. PATENT DOCUMENTS 5,621,196 A * 4/1997 Nishijima et al. ..... 200/6 A
5,952,628 A * 9/1999 Sato et al. ..... 200/4
6,124,555 A * 9/2000 Isikawa ..... 200/4
6,184,480 B1 * 2/2001 Nishimoto et al. ..... 200/4
6,396,006 B1 * 5/2002 Yokoji et al. ..... 200/4
6,720,504 B2 * 4/2004 Nishimoto et al. ..... 200/4
6,953,900 B2 * 10/2005 Sottong ..... 200/5 R
7,087,848 B1 * 8/2006 Yamasaki et al. ..... 200/6 A
7,193,166 B2 * 3/2007 Sakurai et al. ..... 200/5 R
7,227,090 B2 * 6/2007 Kakuno et al. ..... 200/6 A
7,297,882 B2 * 11/2007 Badarneh ..... 200/5 R
7,368,673 B2 * 5/2008 Sato ..... 200/5 R

FOREIGN PATENT DOCUMENTS

JP 2004-087290 3/2004

* cited by examiner

*Primary Examiner*—Michael A Friedhofer
(74) *Attorney, Agent, or Firm*—RatnerPrestia

(57) ABSTRACT

A multi-directional input device includes an operating shaft capable of rotating around a central axis thereof and tilting in multiple directions from the central axis; a rotating body rotating together with the operating shaft to sequentially connect or disconnect a slide contact and a fixed contact; and a plurality of horizontal push switches operable by tilting the operating shaft. The engaging surface between the operating shaft and the rotating body forms a curved surface having both arc element and noncircular element. The operating shaft and the rotating body are always in contact with each other in a large area. Thus, in both tilting and rotating operation, even an extended period of use causes less abrasion.

11 Claims, 18 Drawing Sheets

MULTI-DIRECTIONAL INPUT DEVICE

TECHNICAL FIELD

The present invention relates to a multi-directional input device for use in the input operation part or the like of various kinds of electronic equipment.

BACKGROUND ART

As recent development of multi-functionality of various kinds of electronic equipment, a multi-directional input device has been more frequently used for the input operation part disposed to operate the equipment. For such a multi-directional input device, rotating or pushing one control knob allows the corresponding input operation, and further tilting the one control knob allows the input operation in the direction in which the control knob is tilted.

Now, a description is provided of an example of a conventional multi-directional input device, with reference to the accompanying drawings. FIG. 24 is a sectional view of a conventional multi-directional input device. FIG. 25 is an exploded perspective view thereof. FIG. 26 is a top view thereof. With reference to these drawings, rotational encoder 1 including a push-on switch incorporates an incremental encoder element and a switch element in the space formed by a case member and a cover member thereof. When operating shaft 2 projecting upwardly from the center position of the cover member is rotated, two-phase pulse signals having a phase difference are supplied from the encoder element through terminals. When operating shaft 2 is pressed, the switch element is operated and electrical continuity is established between predetermined ones of the terminals.

Rotational encoder 1 is mounted on upper substrate 5 shaped into a regular octagon as seen from the top. Upper substrate 5 is supported by a pair of first support shafts 9 so as to be rockable about first rocking axis line M-M of frame 7 surrounding the upper substrate. Frame 7 is supported with respect to rocking supports 11A provided on lower substrate 11 by a pair of second support shafts 13 so as to be rockable about second rocking axis line N-N. First rocking axis line M-M is orthogonal to second rocking axis line N-N. On lower substrate 11, press switches 15A, 15B, 15C, and 15D are disposed equidistantly from operating shaft 2 in the center at a pitch of 90°. Pressing projections 5A, 5B, 5C, and 5D projecting from the bottom face of upper substrate 5 are faced to the operating buttons of the corresponding switches. In the positions between pressing projections 5A, 5B, 5C, and 5D on the bottom face of upper substrate 5, control projections 5E, 5F, 5G, and 5H projecting downwardly are also provided.

The conventional multi-directional input device is structured as above. When the device is used, one control knob 17 is attached to operating shaft 2 of rotational encoder 1 to provide a mounting state.

Next, a description is provided of the operation in the mounting state. Rotating control knob 17 rotates operating shaft 2 of rotational encoder 1 and operates the encoder element, thereby providing incremental encoder output. Pressing control knob 17 in the perpendicularly downward direction moves operating shaft 2 downwardly via control knob 17 and operates the switch element. Tilting control knob 17 in the respective directions in which press switches 15A through 15D are disposed rocks upper substrate 5 in the corresponding directions. For example, as shown by the arrow in FIG. 24, control knob 17 is tilted in the direction in which press switch 15A is disposed. Then, upper substrate 5 rocks so that the side of pressing projection 5A lowers. Lowered pressing projection 5A presses the operating button of press switch 15A, thus switching the state of press switch 15A. At this time, control projections 5E and 5H adjacent to pressing projection 5A are brought into contact with lower substrate 11, thus stopping the tilting of upper substrate 5. Next, removing the tilting force allows press switch 15A to self-restore to the original state thereof. The restoring force pushes pressing projection 15A back to the inoperative state of FIG. 24 in which upper substrate 5 is positioned in a horizontal state. For example, Patent Document 1 is known as the information on related art of the present invention.

In order to allow the rocking operation of upper substrate 5 in the tilting operation of control knob 17, the conventional multi-directional input device has the following structure. Upper substrate 5 is supported with respect to frame 7 by the pair of first support shafts 9 so as to be rockable, and frame 7 is supported with respect to lower substrate 11 by the pair of second support shafts 13 so as to be rockable. Further, rotational encoder 1 is mounted on upper substrate 5. With this structure, the stress in the perpendicularly downward direction applied when control knob 17 is pressed is concentrated on the above small supporting portions. For this reason, an extended period of repeated pressing operations in the perpendicularly downward direction or repeated tilting operations can cause scraping or abrasion in the portions supporting the shafts, thus increasing the play and rattle in the above portions.

[Patent Document 1] Japanese Patent Unexamined Publication No. 2004-087290

SUMMARY OF THE INVENTION

The present invention includes the following elements: an operating shaft capable of rotating around a central axis thereof and tilting in multiple directions from the central axis; and a rotating body rotating together with the operating shaft so that the rotation sequentially connects or disconnects a slide contact and a fixed contact. The present invention further includes a plurality of horizontal push switches that are disposed around the operating shaft with the central axis as the center thereof and are operable by tilting the operating shaft.

The surface on which the operating shaft and the rotating body engage with each other when the operating shaft is tilted has an arc shape in a section including the central axis, and a noncircular shape in a section perpendicular to the central axis. The noncircular sections include a polygonal section. The operating shaft is in contact with the rotating body by "clearance fit" having a small clearance. Because the engaging surface has such a section, when the operating shaft is rotated, the noncircular, i.e. polygonal, portion of the operating shaft securely engages the rotating body, and thus allows the rotating body to rotate together. When the operating shaft is tilted, the arc portions of the operating shaft smoothly slide on the rotating body. The structure of bearing the stress distributed in a wide area in both rotating and tilting operations produces no local friction and little abrasion. In other words, no rattle caused by an extended period of use can increase the life of the device.

REFERENCE MARKS IN THE DRAWINGS

Figure 1:
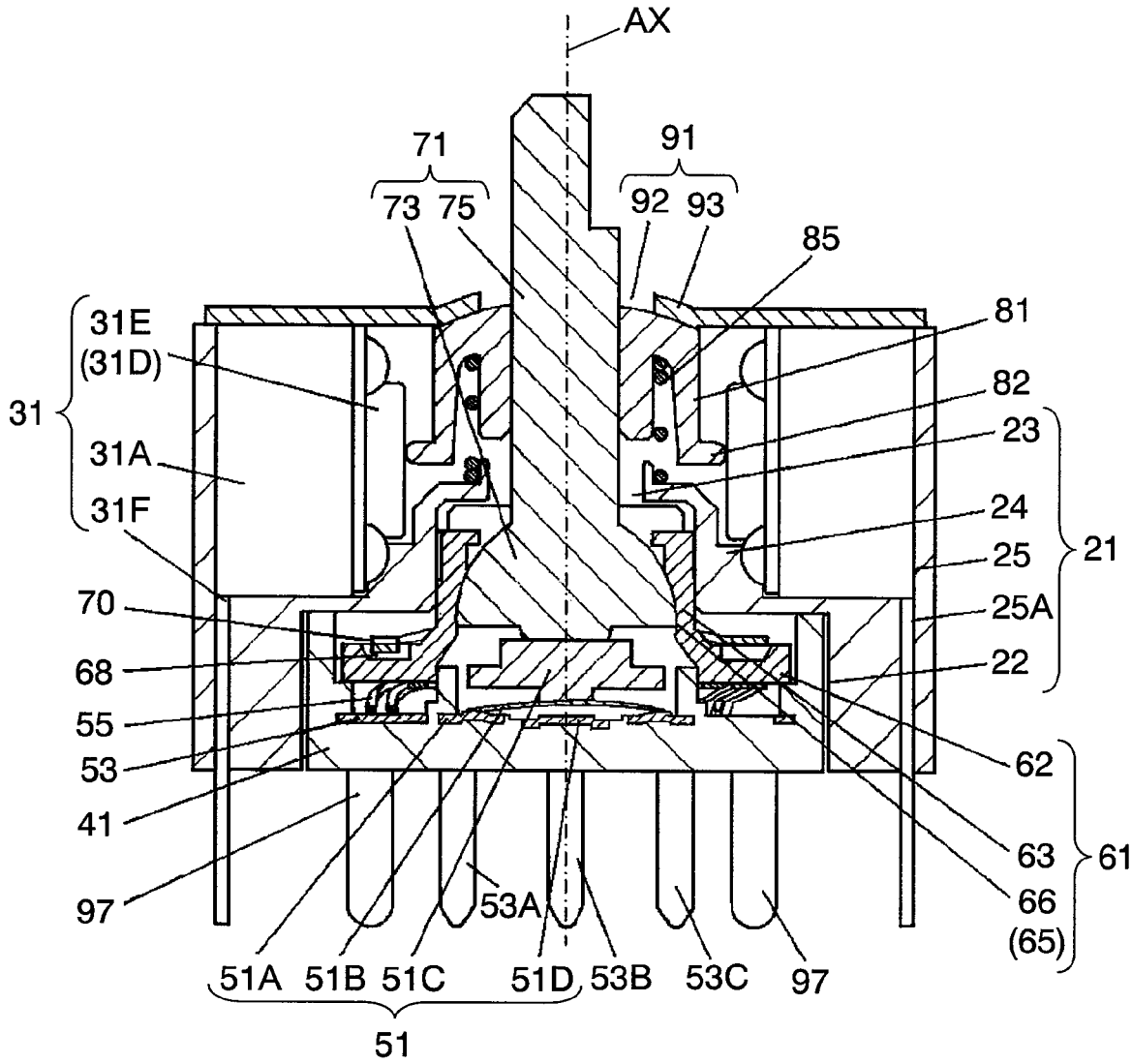
FIG. 1 is a sectional view of a multi-directional input device in accordance with an exemplary embodiment of the present invention.

21 Case part
22 Contact substrate mounting part
23 Center hole
24 Cylindrical holder
25 Switch mounting part
25A Slot for terminal
27 Intermediate wall
29A Coupling through-hole
29B Through-hole for auxiliary leg
31 Horizontal push switch
31A Horizontal push switch case
31B Horizontal push switch fixed contact
31C Horizontal push switch movable contact
31D Horizontal push switch pressing member
31E Horizontal push switch operating button
31F Horizontal push switch terminal
41 Contact substrate
51 Press switch part
51A First fixed contact
51B Dome-shaped movable contact
51C Push plate
51D Second fixed contact
51E, 51F Switch terminal
53 Fixed contact for rotation
53A, 53B, 53C Encoder terminal
55 Slide contact
61 Rotating body
62 Flange portion
63 Upper circular portion
65 Center through-hole
66 Engaging hole portion
68 Asperity portion
70 Click spring
71 Operating shaft
73 Polygonal sphere portion
75 Cylindrical portion
81 Driver
82 Pressing part
85 Coil spring
91 Metal cover
92 Noncircular center hole
93 Top face part
95 First leg
97 Second leg
99 Control knob
100 Driver
101 Pressing part
AX Central axis

DETAILED DESCRIPTION OF PREFERRED EMBODIMENT

Figure 2:
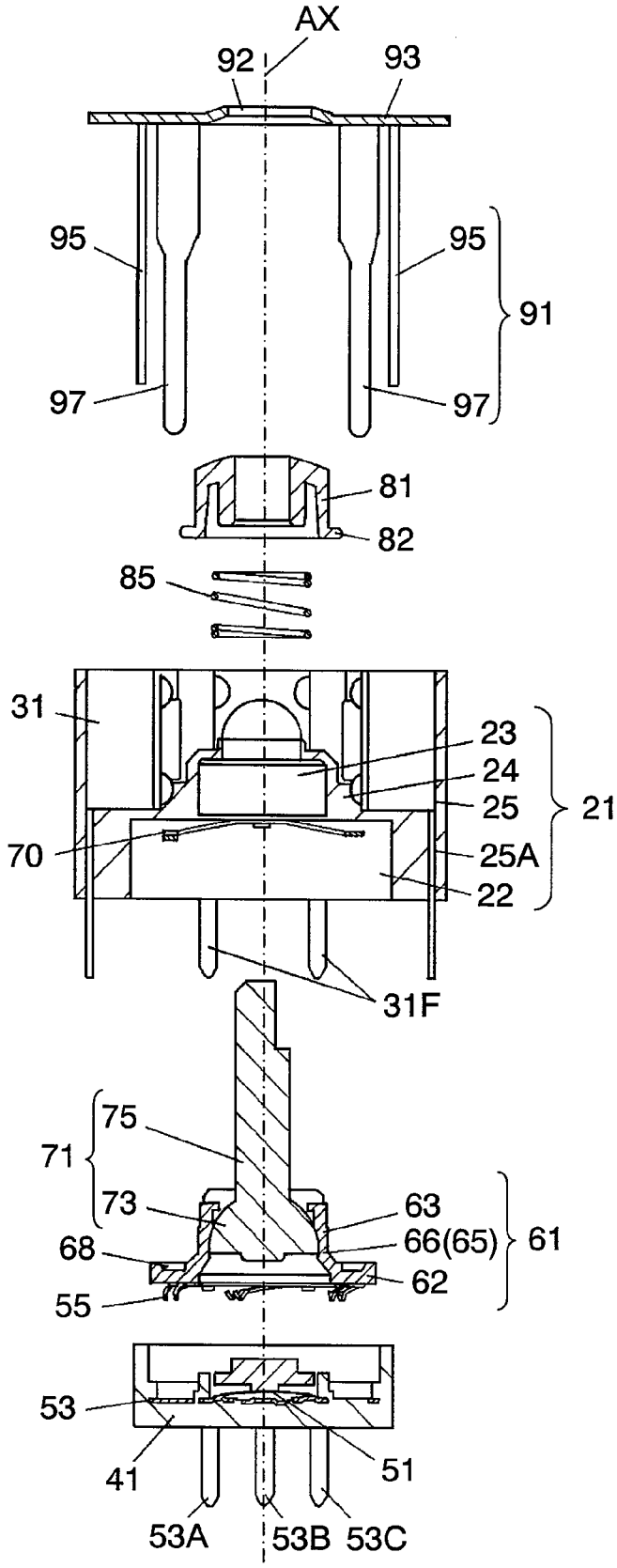
FIG. 2 is a sectional view of the multi-directional input device in a disassembled state.
Figure 3:
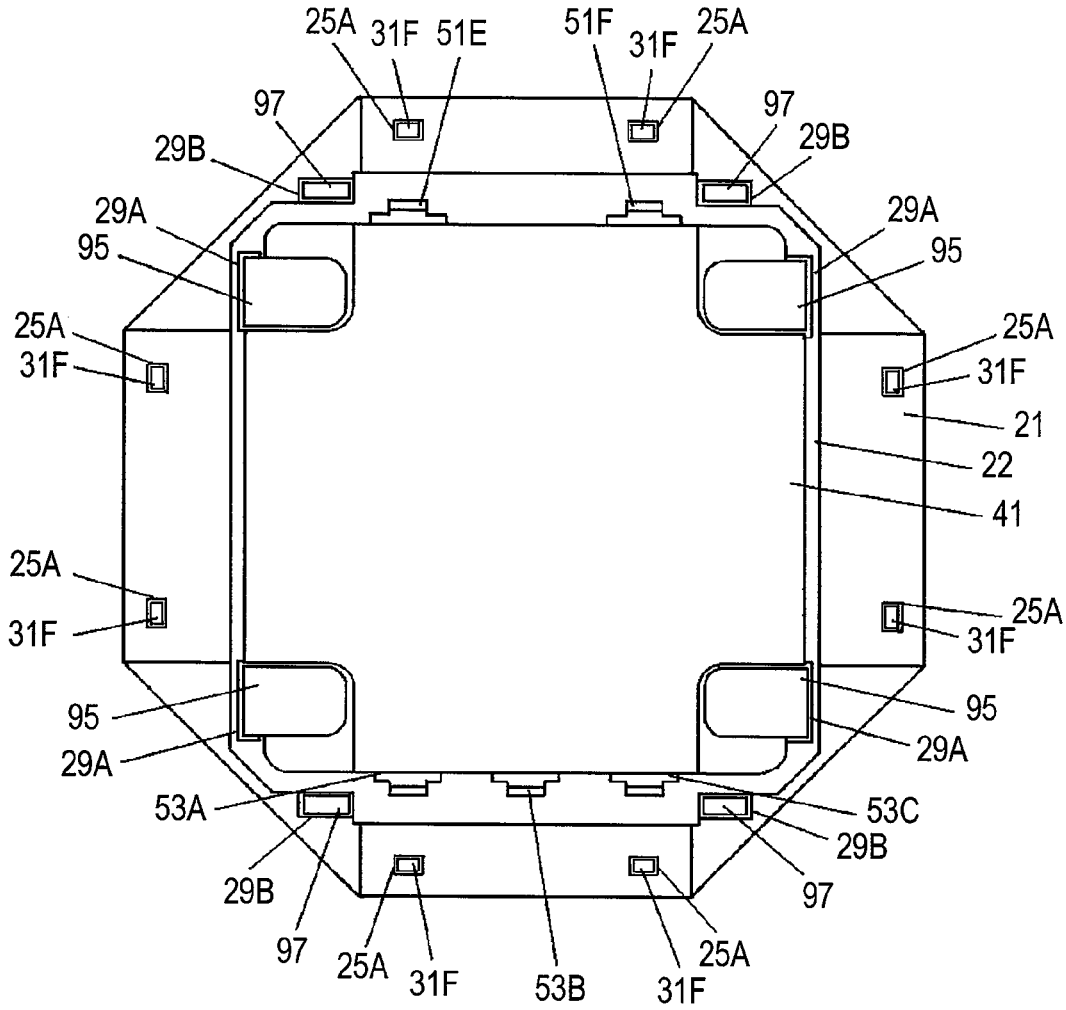
FIG. 3 is a bottom view of the multi-directional input device.
Figure 4:
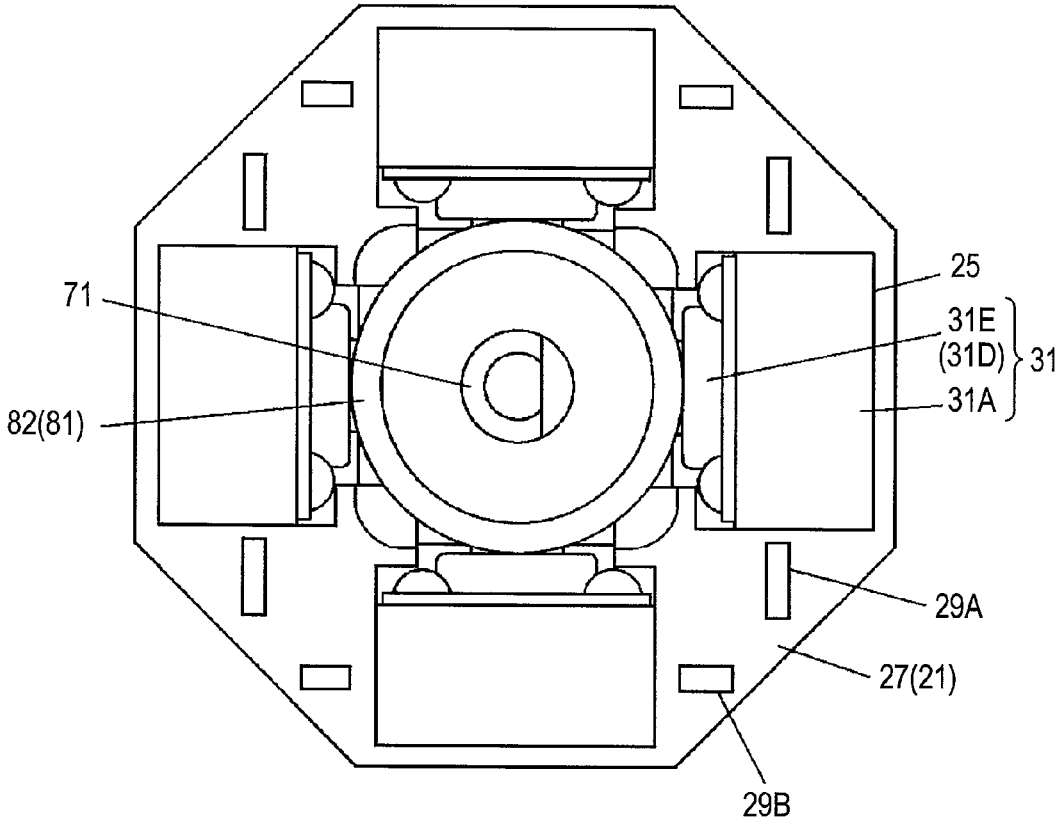
FIG. 4 is a top view of the multi-directional input device with a metal cover thereof removed.
Figure 5:
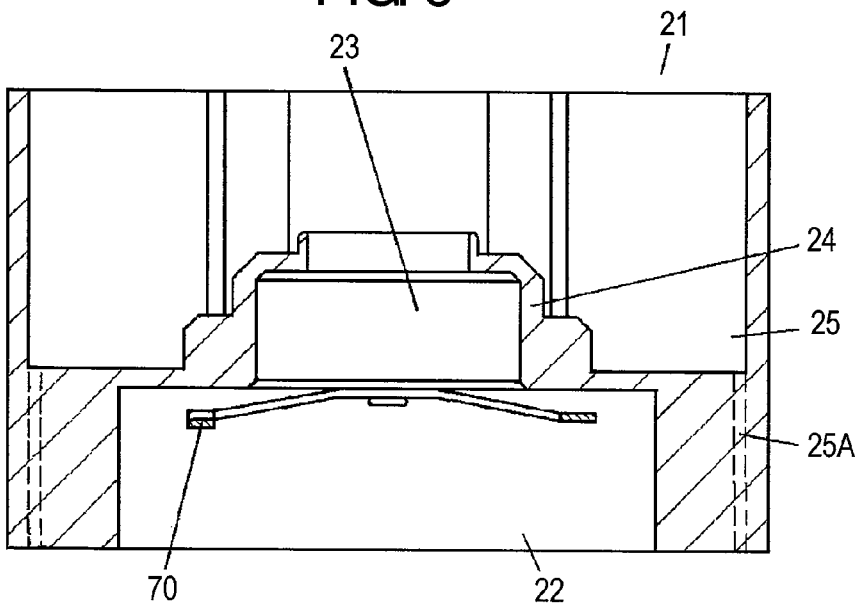
FIG. 5 is a sectional view of a case part of the multi-directional input device.
Figure 6:
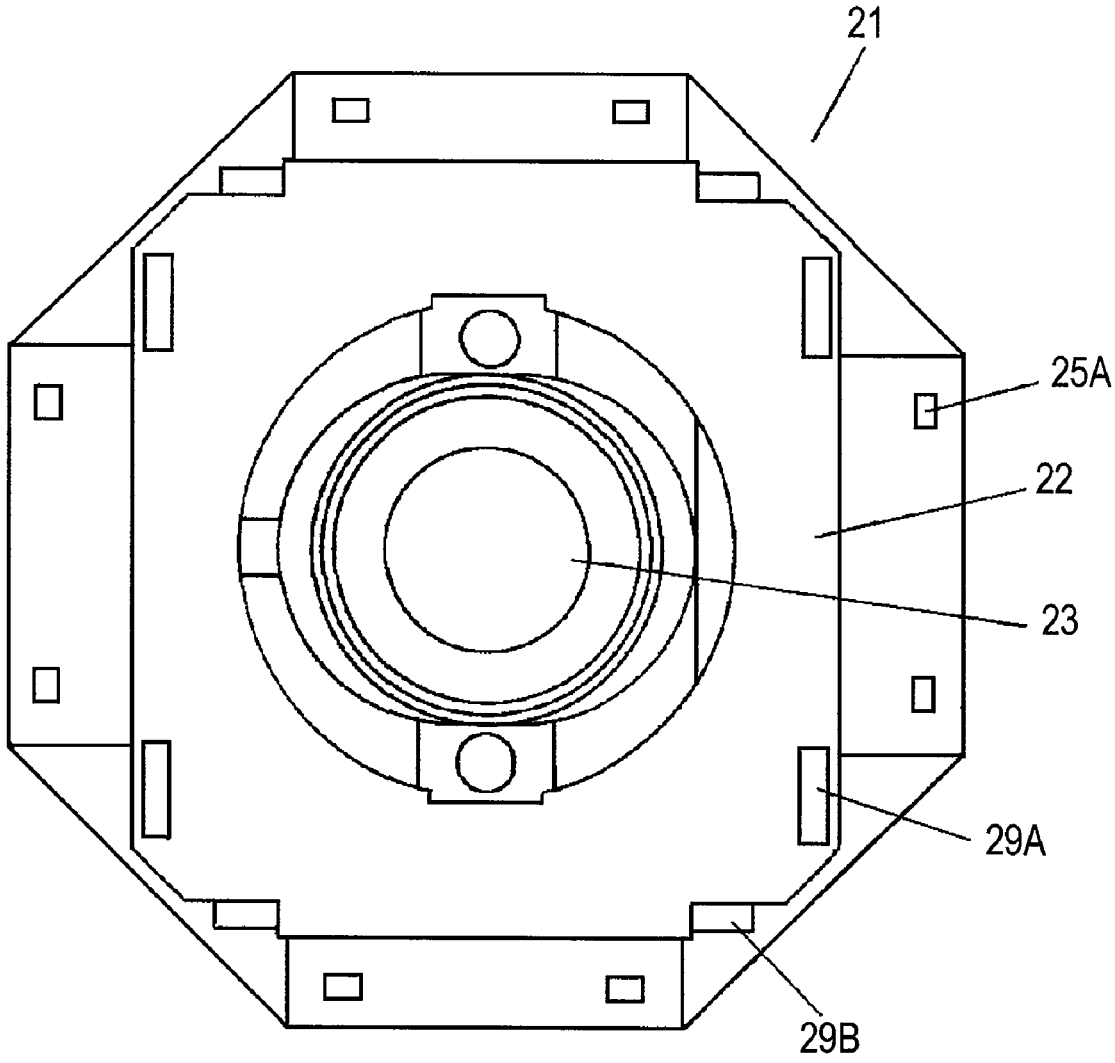
FIG. 6 is a bottom view of the case part.
Figure 7:
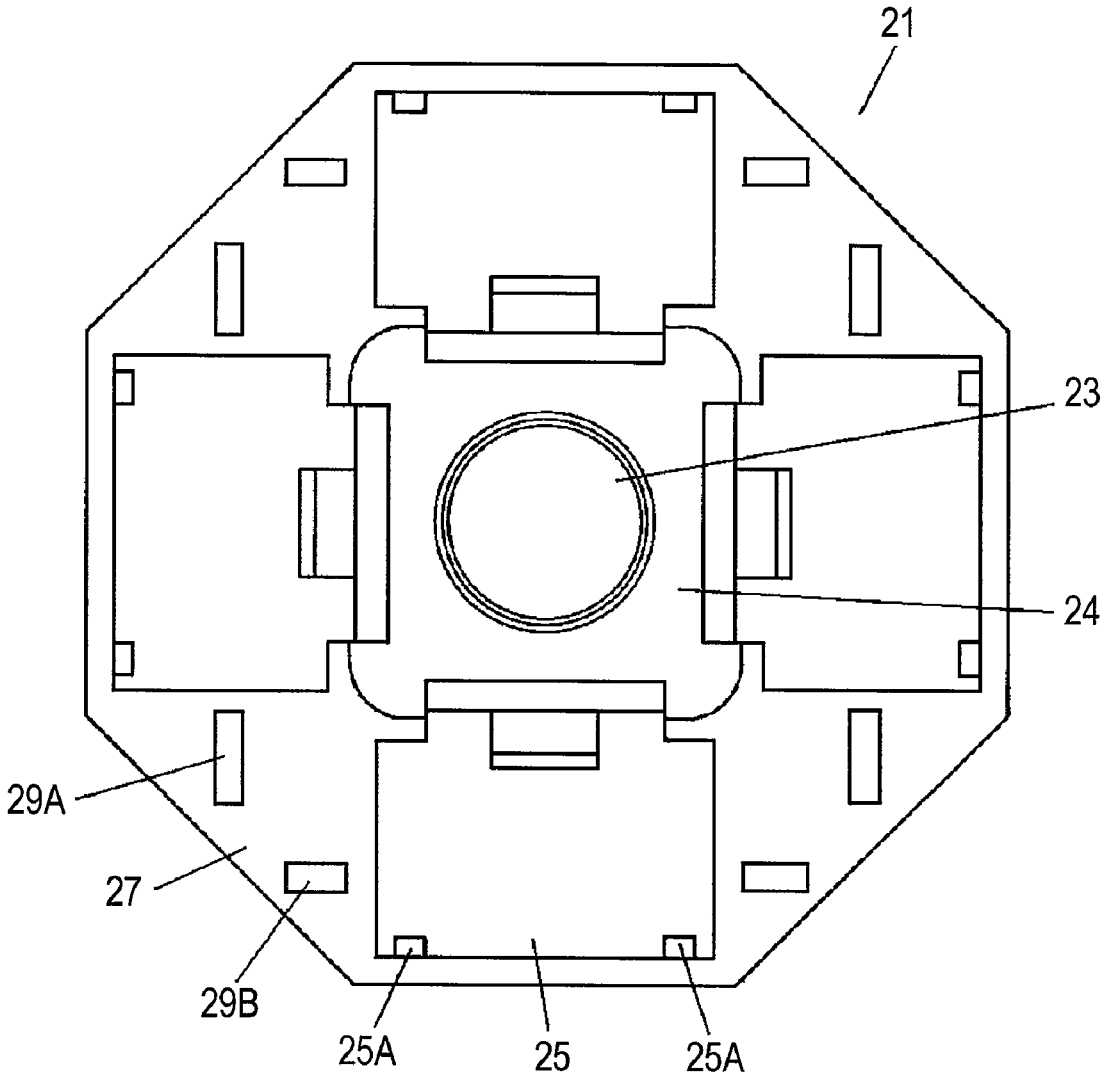
FIG. 7 is a top view of the case part.

FIG. 1 is a sectional view of a multi-directional input device in accordance with the exemplary embodiment of the present invention. FIG. 2 is a sectional view of the multi-directional input device in a disassembled state disassembled in the direction of central axis AX. FIG. 3 is a bottom view thereof. FIG. 4 is a top view thereof with a metal cover thereof removed. FIG. 5 is a sectional view of a case part thereof. FIG. 6 is a bottom view of the case part. FIG. 7 is a top view of the case part. With reference to these drawings, case part 21 made of a molded resin includes, in the center position of a bottom thereof, contact substrate mounting part 22 in substantially a cubic recessed shape opened on the bottom side thereof. Above contact substrate mounting part 22, cylindrical holder 24 connecting to contact substrate mounting part 22 and centered on center hole 23 is formed. In four upper circumferential positions equidistantly spaced from cylindrical holder 24 at a pitch of 90°, switch mounting parts 25 for horizontal push switches are formed. In the position on the bottom of each switch mounting part 25, a pair of penetrating slots for terminal 25A is provided. Theses elements are assembled with the centerline shown in FIG. 2, i.e. central axis AX, at the center. Detailed description of each drawing will be provided later.

Figure 8:
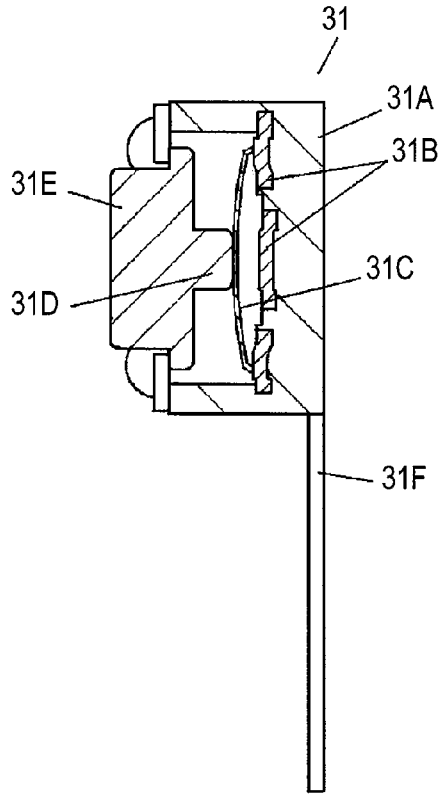
FIG. 8 is a sectional view of a horizontal push switch of the multi-directional input device.

FIG. 8 shows a sectional view of horizontal push switch 31 of self-restoring type. Switch case 31A of horizontal push switch 31 includes a recess opened on a lateral side thereof. On the inner bottom face of the recess, a pair of fixed contacts 31B is disposed. In the recess, dome-shaped movable contact 31C is housed. Pressing member 31D disposed to press movable contact 31C toward switch case 31A is faced to switch case 31A so as to be movable in the lateral direction of the drawing. Operating button 31E of pressing member 31D is protruded in the direction opposite to switch case 31A. A pair of terminals 31F extending from corresponding fixed contacts 31B is linearly projected on the bottom side of switch case 31A.

Horizontal push switches 31 of the above structure are positioned and held in case 21 as shown in FIG. 2 in the following manner. While respective operating buttons 31E are faced to the central side, i.e. the side of central axis AX, of case part 21, the four horizontal push switches are fitted into switch mounting parts 25 in case part 21 from the upper direction thereof. Terminals 31F of each horizontal push switch 31 are threaded through penetrating slots for terminal 25A and projected downwardly of the bottom face position of case part 21.

On the other hand, in contact substrate mounting part 22 of case part 21, contact substrate 41 formed to have substantially a cubic external shape conforming to the recessed shape of the contact substrate mounting part is inserted and placed from the bottom face of case part 21. As shown in FIG. 2, contact substrate 41 includes a recessed part having an open top face. Press switch part 51 is formed in the center position of the recessed part. On the bottom face of the recessed part in the peripheral position, fixed contact for rotation 53 is fixed to be exposed.

As shown in FIG. 1, in press switch part 51, the outer peripheral bottom edge of dome-shaped movable contact 51B made of a thin metal plate is placed on first fixed contact 51A fixed in the peripheral position of the inner bottom face of contact substrate 41 so that the edge is always in contact with the fixed contact. In the structure of press switch part 51, second fixed contact 51D similarly fixed in the center position of the inner bottom face is faced to the inner surface of the dome part with a space provided therebetween. When dome-shaped movable contact 51B is pressed via push plate 51C disposed above and the dome part is resiliently inverted, second fixed contact 51D in the center position is brought into contact with the inner surface of the dome part. In other words, this operation electrically connects first fixed contact 51A and second fixed contact 51D. Removing the above pressing force allows dome-shaped movable contact 51B to self-restore to the original shape thereof and to push back push plate 51C. In other words, fixed contacts 51A and 51D are electrically disconnected again.

Figure 9:
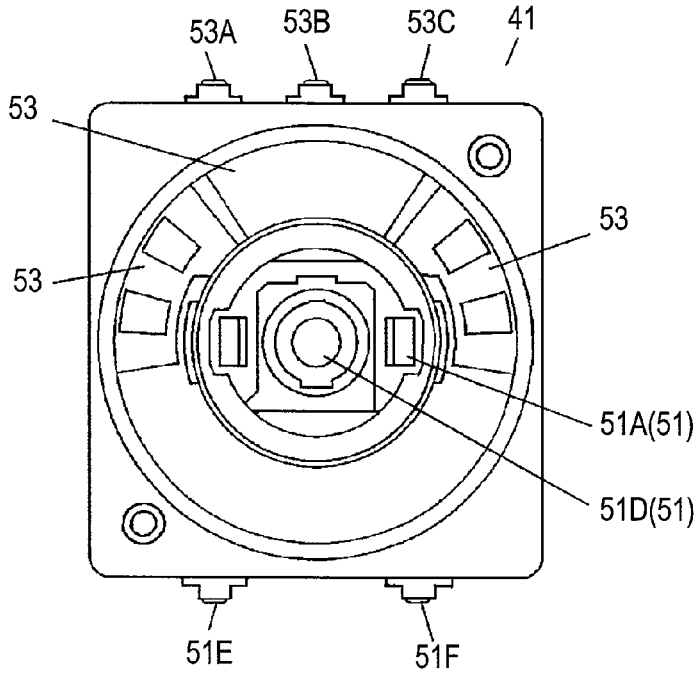
FIG. 9 is a top view of a contact substrate of the multi-directional input device.

FIG. 9 shows a top view of contact substrate 41. Fixed contact for rotation 53 is formed in the following manner. A metal plate is punched to have a contact pattern capable of providing incremental encoder output and the contact pattern is fixed onto the inner bottom face of contact substrate 41 so as to be exposed. Contact substrate 41 includes encoder terminals 53A, 53B, and 53C lead from the contact pattern and switch terminals 51E and 51F extended from fixed contacts 51A and 51D, respectively.

As shown in FIG. 1, contact substrate 41 is housed and incorporated in contact substrate mounting part 22 of case part 21 so that the top end face of the contact substrate is in contact with the ceiling of the recess in contact substrate mounting part 22. In this state, the bottom face positions of contact substrate 41 and case part 21 are flush with each other.

Figure 10:
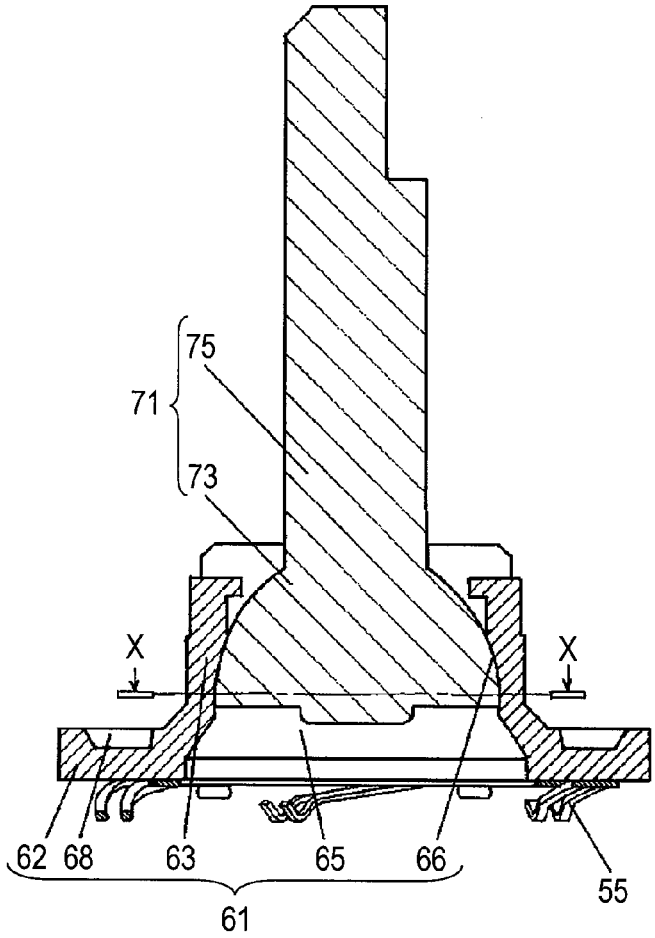
FIG. 10 is a sectional view of a rotating body and an operating shaft of the multi-directional input device combined with each other.
Figure 11:
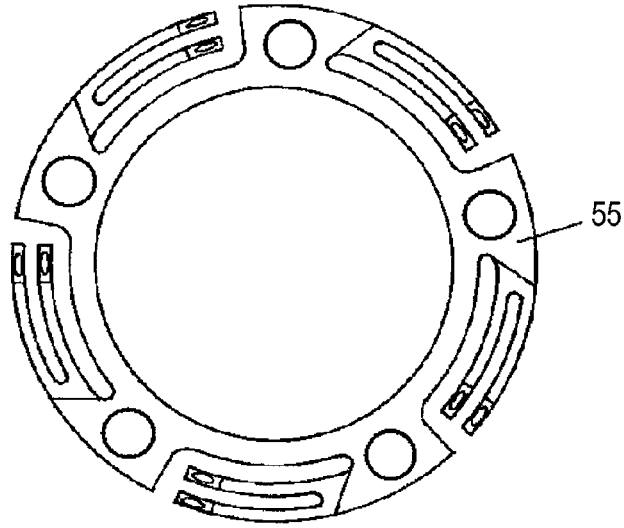
FIG. 11 is a plan view of a slide contact attached to the rotating body.

FIG. 10 shows a sectional view of rotating body 61 and operating shaft 71 combined with each other. FIG. 11 shows a plan view of slide contact 55 attached to rotating body 61. In the recessed part of reference contact substrate 41, rotating body 61 made of a molded resin is disposed. Rotating body 61 includes flange portion 62 that has slide contact 55 in sliding contact with fixed contact for rotation 53, and upper circular portion 63 that upwardly projects in the center of flange portion 62 and has a cylindrical external shape. Rotating body 61 is formed into substantially an annular shape that has center through-hole 65 vertically penetrating in the center position thereof. As shown in FIG. 1, in order to allow rotating body 61 to rotate with respect to case part 21, the outer periphery of the bottom face of flange portion 62 is placed on the step provided in the inner bottom face of contact substrate 41, and upper circular portion 63 is inserted in cylindrical holder 24 of case part 21 from the bottom thereof and rotatably fitted in and held by the cylindrical holder. Asperity portion 68 is formed on the top face of flange portion 62 to provide a click feel in the rotating operation. Click spring 70 in resilient contact with the asperity portion is fixed onto the ceiling of contact substrate mounting part 22 by dowel-caulking or the like, as shown in FIGS. 5 and 6.

With reference to FIG. 1, bar-shaped operating shaft 71 threaded through center through-hole 65 of rotating body 61 is disposed on central axis AX so that the bottom end of the operating shaft is brought into contact with the top face of push plate 51C of press switch part 51 disposed in a lower position of center through-hole 65. The upper portion of the operating shaft projecting from center through-hole 65 (see FIG. 10) penetrates through center hole 23 of cylindrical holder 24 and noncircular center hole 92 of metal cover 91 and projects outwardly.

Figure 12:
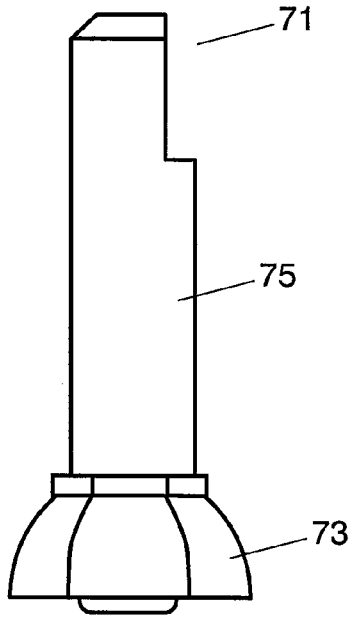
FIG. 12 is a side view of the operating shaft.
Figure 13:
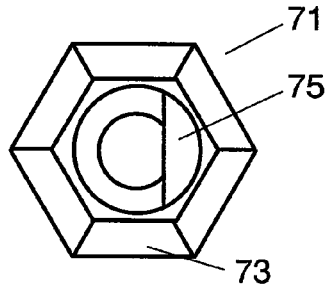
FIG. 13 is a top view of the operating shaft.

As shown in FIG. 10, the outer periphery of the lower portion of operating shaft 71 is engaged to the inner wall of center through-hole 65 of rotating body 61 so that the operating shaft can be moved vertically, rotated, and tilted. Now, a description is provided of the engaging portion. FIG. 12 shows a side view of operating shaft 71. FIG. 13 shows a top view of the operating shaft. As understood from FIGS. 12 and 13, the external shape of the outer periphery of the lower portion of operating shaft 71 is shaped into a regular hexagon as seen from the top, i.e. in a section perpendicular to central axis AX. As seen from a side, the upper side of the lower portion is formed into substantially a spherical shape. In other words, in a section including central axis AX, the upper side is formed into polygonal sphere portion 73 including arc portions. The spherical shape is not necessarily a real sphere.

For the shape of center through-hole 65 of rotating body 61, engaging hole portion 66 is formed at an intermediate height thereof to include an inner wall having the same shape as polygonal sphere portion 73. Center through-hole 65 in a position lower than this position is formed into a hole portion having a larger diameter. Push switch plate 51C of press switch part 51 is disposed in the larger-diameter hole portion in the lower position. Press switch part 51 is thus disposed.

Figure 14:
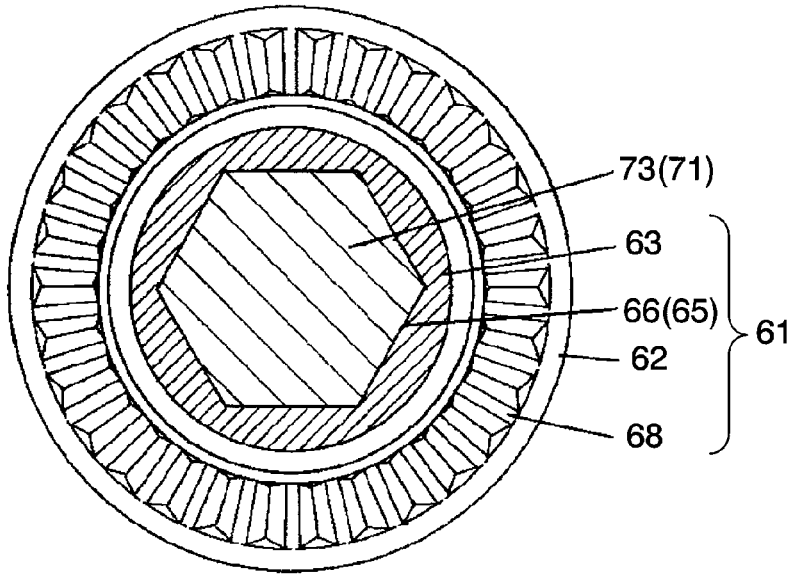
FIG. 14 is a sectional view taken on line X-X of FIG. 10.

FIG. 14 is a section taken on line X-X of FIG. 10 as seen from the top. As shown in FIG. 14, operating shaft 71 is inserted from the bottom of the engaging hole portion, and polygonal sphere portion 73 is engaged to engaging hole portion 66. As described with reference to FIG. 1, the bottom end of the operating shaft is placed on push plate 51C of press switch part 51. In this placement state, an upward urging force from press switch part 51 is applied to operating shaft 71. This urging force keeps the spherical wall of engaging hole portion 66 and the spherical wall of polygonal sphere portion 73 in contact with each other, and thus operating shaft 71 in a neutral position thereof. Further, operating shaft 71 can be moved vertically by pressing operation from the upward direction.

Operating shaft 71 disposed in the above engaging state engages the rotating body at the corners of the regular hexagon as seen from the top also in the rotation direction. Thus, when rotated, operating shaft 71 rotates around the bottom end thereof that is in contact with the top face of push plate 51C. The engagement of the operating shaft and the rotating body at the respective corners thereof allows rotating body 61 to rotate together. To make the rotating body rotatable, the operating shaft need not have a section perpendicular to central axis AX shaped into a regular hexagon in this manner. For this purpose, simply a noncircular section is sufficient. However, when the stress to be applied from operating shaft 71 to rotating body 61 in the rotating operation is considered, a shape capable of distributing the stress as much as possible is preferable. This is because such a shape can prevent scraping and abrasion caused by the concentrated stress. The preferable sectional shapes include a regular hexagon as shown in this exemplary embodiment, and regular polygons each centered on central axis AX, such as a square and regular octagon, because these shapes uniformly and widely distribute the stress.

Further, when a tilting force is applied to operating shaft 71 in the above engaging state, polygonal sphere portion 73 can rotate with respect to engaging hole portion 66, and operating shaft 71 can tilt. At this time, operating shaft 71 and rotating body 61 are in contact with each other in the respective arc portions in a large area, and thus the contact is smooth and less abrasive. The opening of center through-hole 65 of rotating body 61 in the top end position is shaped so that the desired tilting angle of operating shaft 71 can be ensured. The multi-directional input device may be structured so that the tilting angle is controlled in the top end position of center through-hole 65.

Figure 15:
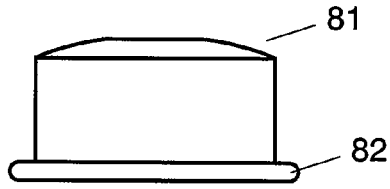
FIG. 15 is a side view of a driver of the multi-directional input device.
Figure 16:
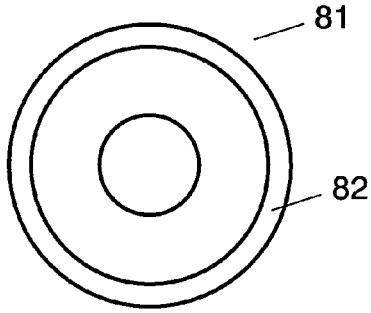
FIG. 16 is a top view of the driver.

As shown in FIG. 1, operating shaft 71 includes cylindrical portion 75 having a circular section in the intermediate portion above polygonal sphere portion 73. Cylindrical portion 75 goes through the center positions between corresponding operating buttons 31E of four horizontal push switches 31 and projects upwardly on central axis AX. On cylindrical portion 75, driver 81 made of a molded resin is disposed to press operating buttons 31E of horizontal push switches 31. FIG. 15 shows a side view of driver 81. FIG. 16 shows a top view thereof. The driver includes a skirt part that is formed from the top end position of a central cylindrical part having a circular center hole downwardly around the center hole into a cylindrical shape, and pressing part 82 that is formed around the center hole in the lower position of the skirt part and has a circular ring shape as seen from the top. Cylindrical portion 75 of operating shaft 71 is threaded through the center hole of the central cylindrical part and fitted thereto with a small clearance provided therebetween. The corresponding portions in the edge of pressing part 82 are brought into slight pressure contact with operating buttons 31E. The edge of pressing part 82 has a predetermined round shape in the vertical direction thereof. Forming driver 81 into the above non-directional shape, i.e. a shape having a circular section, can provide excellent assembling workability, and thus is preferable.

With reference to FIGS. 1 and 2, metal cover 91 is disposed in the top end position of case part 21, and top face part 93 of the metal cover formed like a flat plate controls the position of the top end faces of horizontal push switches 31. From noncircular center hole 92 provided in the center of top face part 93, the upper portion of operating shaft 71 is projected. A structure in which operating shaft 71 is guided along the edge of noncircular center hole 92 in the tilting operation of operating shaft 71 is preferable because this structure can provide an excellent operability. However, the shape of noncircular hole 92 is not specifically limited.

With reference to FIGS. 1 and 2, coil spring 85 is disposed on cylindrical holder 24 of case part 21 so that the upper portion thereof is housed between the central cylindrical part and the skirt part of driver 81. In a normal state, the spring is placed in a compressed state and thus urges driver 81 upwardly. The urging force brings the top portion of driver 81 shaped into a gentle sphere into contact with the position of top face part 93 near noncircular center hole 92 of metal cover 91 correspondingly shaped into a gentle sphere, and holds these portions together. Coil spring 85 is disposed mainly in order to reduce the rattle or the like of driver 81. For the above-described structure in which the urging force is applied from coil spring 85 to driver 81 in addition to the urging force to pressing part 82, the clearance between the intermediate portion of operating shaft 71 and the fitting portion of driver 81 can be set at a predetermined magnitude. This structure can prevent inadvertent rotation of driver 81 together with operating shaft 71 in the rotating operation thereof.

Figure 17:
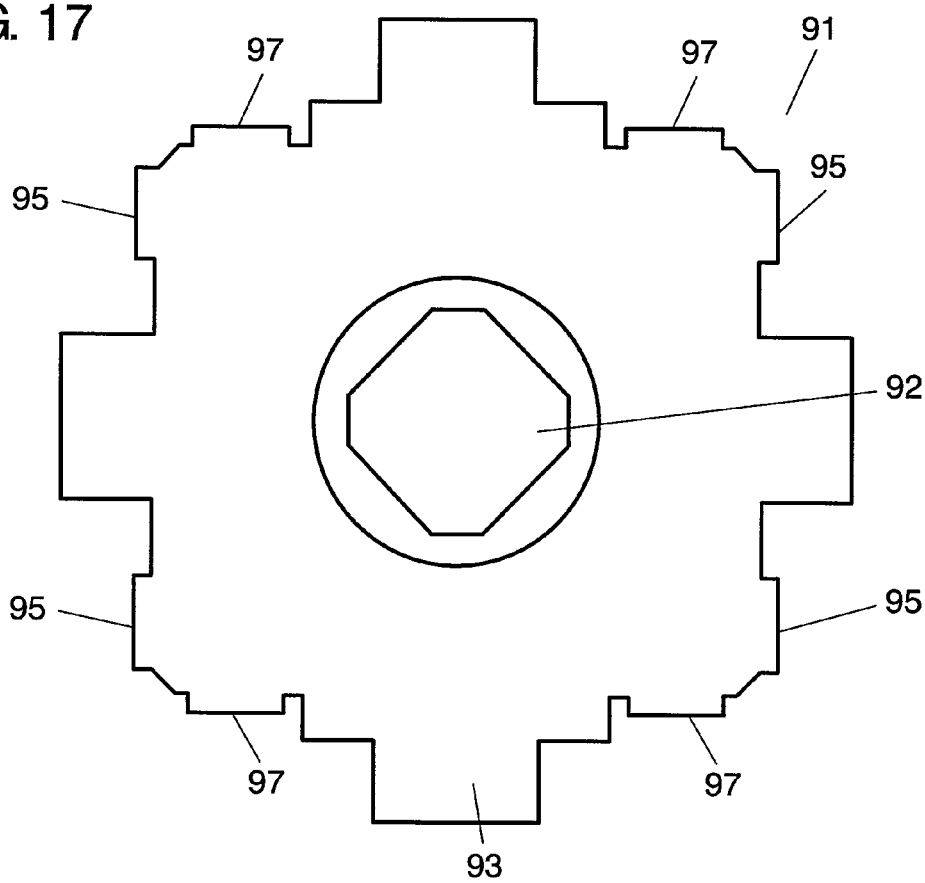
FIG. 17 is a top view of a metal cover of the multi-directional input device.
Figure 18:
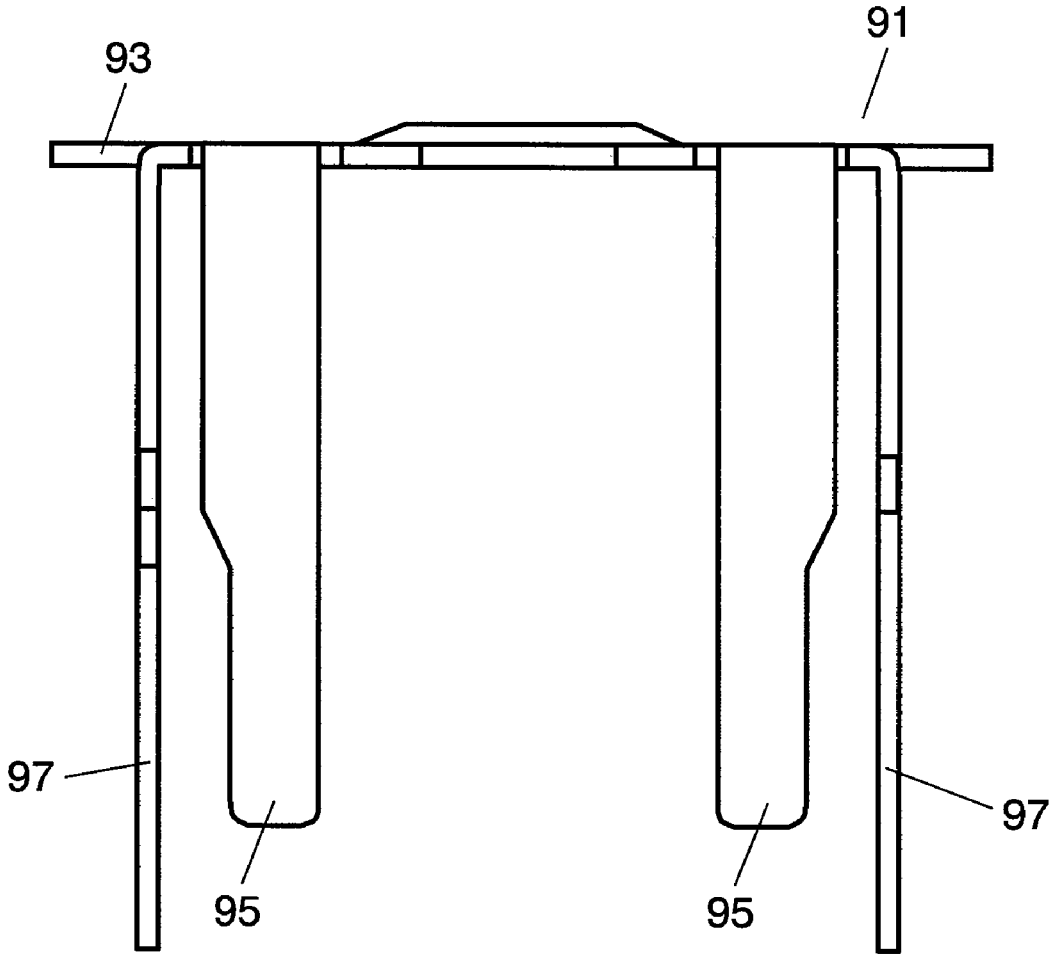
FIG. 18 is a right side view of the metal cover.

Metal cover 91 is a member also working as a coupling means for keeping case part 21 and contact substrate 41 coupled with each other. FIG. 17 is a top view of the metal cover. FIG. 18 is a right side view of the metal cover. As understood from FIGS. 17 and 18, four first legs 95 projecting downwardly are provided on top face part 93 of metal cover 91. First legs 95 are threaded through four coupling through-holes 29A penetrating through intermediate wall 27 of case part 21 from the top face to the bottom face (see FIGS. 4, 6, and 7). The tip of each first leg is bent-caulked onto the bottom side of contact substrate 41 as shown in FIG. 3 so that case part 21 and contact substrate 41 are coupled. Forming coupling through-holes 29A in the position of intermediate wall 27 between switch mounting parts 25 allows effective use of the positions between switch mounting parts 25, thus preventing an increase in outside dimension. Further, fixation in the above manner requires no dedicated coupling members, and thus provides a coupling means without increasing the number of components in the area of case part 21 as seen from the top. For these reasons, the above fixing method is preferable. Further, the above fixing method can extremely stabilize the coupling state. In the above structure, preferably, the portions on the bottom side of contact substrate 41 clamp-caulked by first legs 95 are formed into recesses having a depth corresponding to the thickness of respective first legs 95.

Metal cover 91 further includes a plurality of second legs 97 that project downwardly from top face part 93. In a similar manner, the second legs are threaded through through-holes for auxiliary legs 29B formed through intermediate wall 27 of case part 21 in the positions of intermediate wall 27 between switch mounting parts 25 (see FIGS. 4, 6, and 7), and the tips of the second legs are projected downwardly of case part 21. Second legs 97 are disposed to increase soldering strength.

The multi-directional input device of the present invention is structured as described above. Next, a description is provided of the operation thereof. First, when operating shaft 71 is rotated, operating shaft 71 rotates with the bottom end thereof in contact with the top face of push plate 51. As operating shaft 71 rotates, rotating body 61 that receives polygonal sphere portion 73 engaged to engaging hole portion 66 thereof rotates together with operating shaft 71. Thus, slide contact 55 attached to the bottom face of flange portion 62 slides on fixed contact for rotation 53 and the contacts are sequentially and electrically connected or disconnected. This operation provides predetermined incremental encoder output from encoder terminals 53A through 53C. At that time, the dowel portion of click spring 70 fixed to the ceiling of contact substrate mounting part 22 makes resilient contact with asperity portion 68 provided on the top face of flange 62. Thus, a click feel can be provided at the same time. When the state of driver 81 fitted to the intermediate position of operating shaft 71 is adjusted to prevent inadvertent rotation thereof, an excellent operating feel can be provided. Thus, such a structure is preferable.

Figure 19:
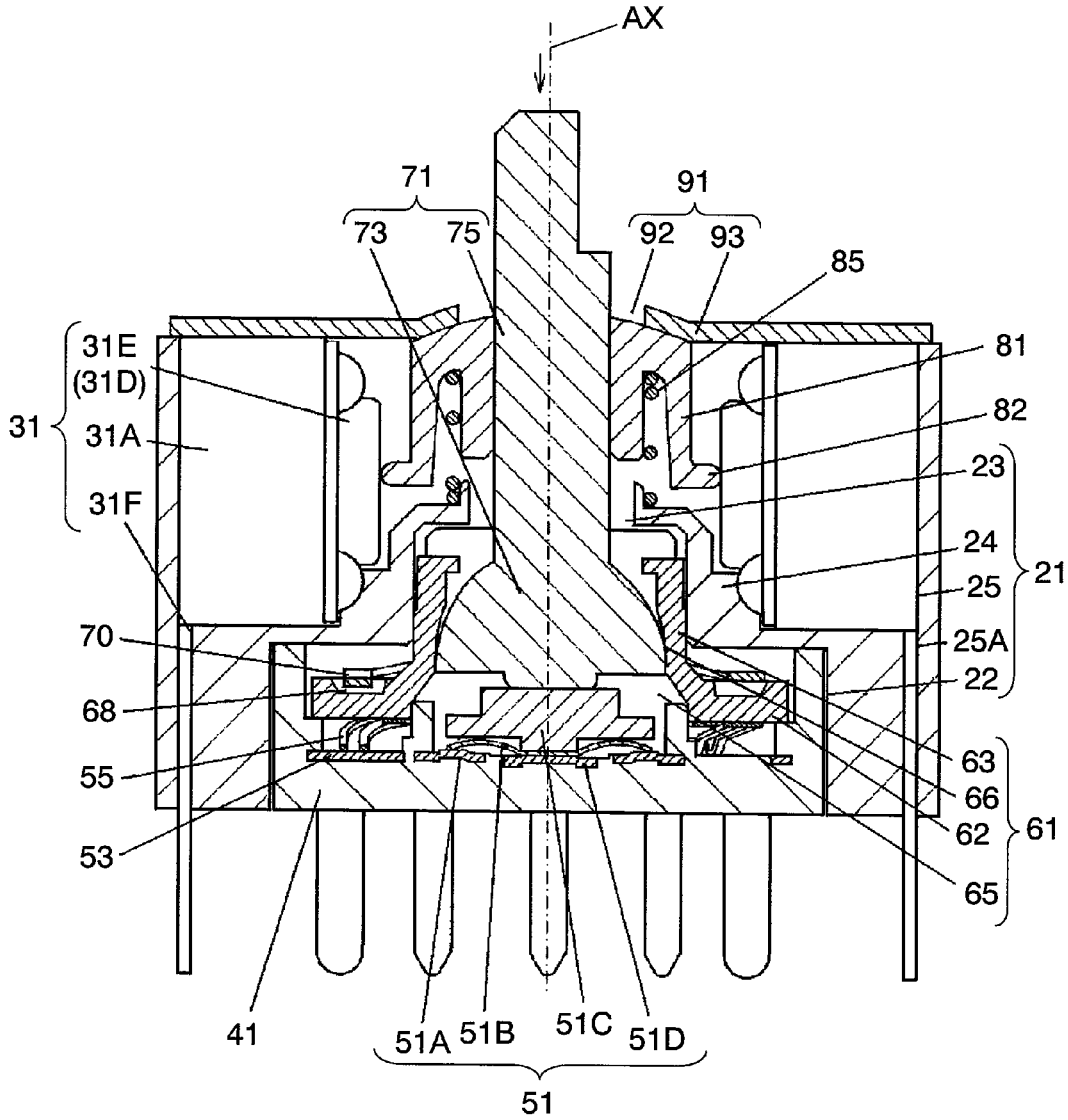
FIG. 19 is a sectional view of the multi-directional input device in pressing operation.

Next, a description is provided of the operation when operating shaft 71 is pressed downwardly. FIG. 19 is a sectional view of the multi-directional input device in pressing operation. Pressing operating shaft 71 downwardly along central axis AX as shown by the arrow in the drawing does not move driver 81 and only moves operating shaft 71 downwardly. Thus, the pressing force is applied to press switch part 51 via push plate 51C. When the force exceeds a predetermined magnitude, the dome part of dome-shaped movable contact 51B is resiliently inverted as shown in FIG. 19. This inversion electrically connects first fixed contact 51A and second fixed contact 51D of contact substrate 41, thus establishing electrical continuity between switch terminals 51E and 51F. Removing the above operating force thereafter allows dome-shaped movable contact 51B to self-restore to the original upwardly convex shape and to push up push plate 51C and operating shaft 71. Thus, the multi-directional input device returns to the normal state of FIG. 1 in which switch terminals 51E and 51F are electrically disconnected. The position in which operating shaft 71 returns upwardly is controlled by the contact of polygonal sphere portion 73 of operating shaft 71 with the inner wall of engaging hole portion 66.

Figure 20:
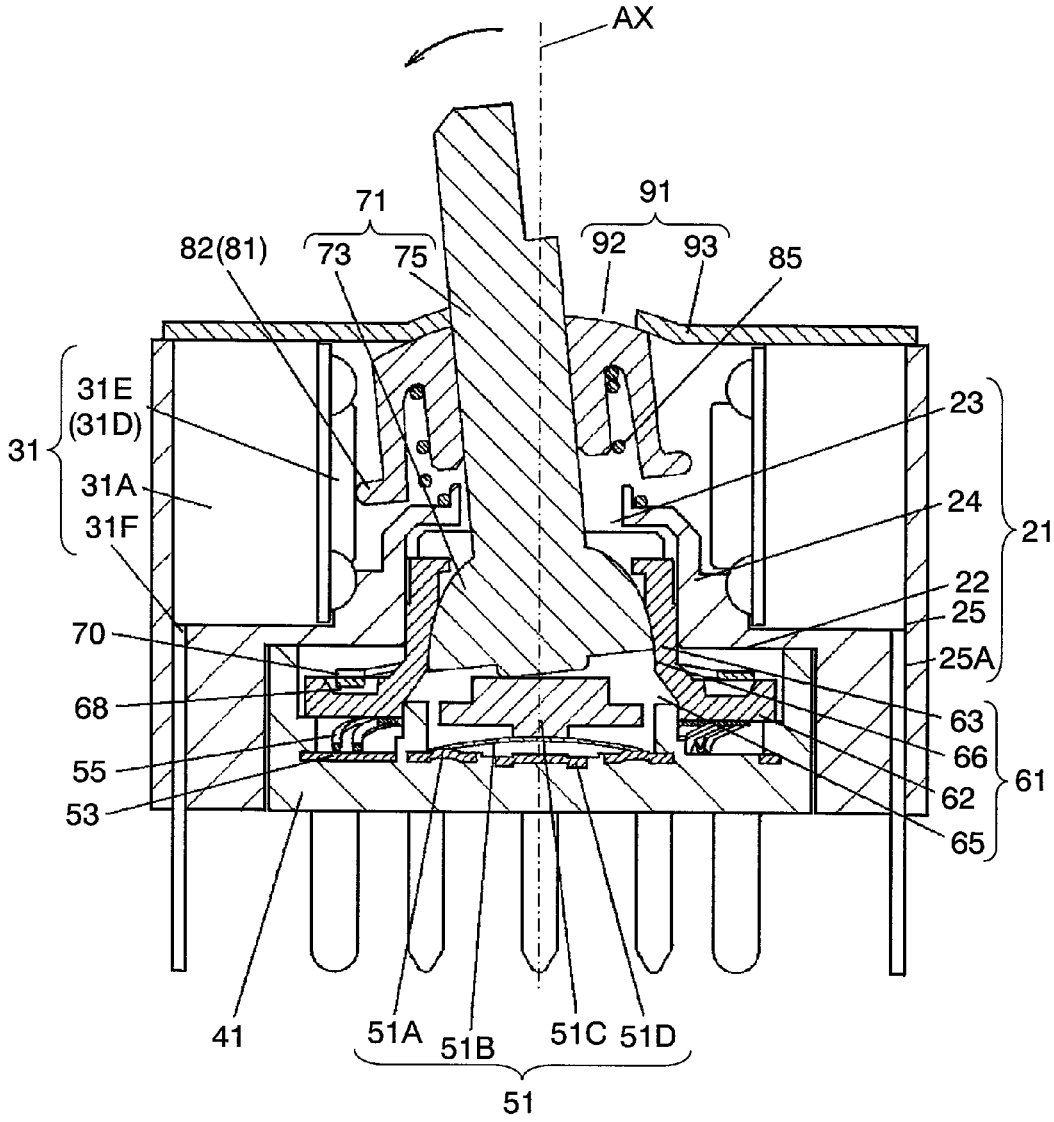
FIG. 20 is a sectional view of the multi-directional input device in tilting operation.

Next, a description is provided of the operation when operating shaft 71 is tilted. FIG. 20 is a sectional view of the multi-directional input device in tilting operation. The drawing shows the multi-directional input device when the operating shaft is tilted in the left direction as shown by the arrow in the drawing. When a tilting force is applied to operating shaft 71, polygonal sphere portion 73 provided in the lower portion thereof rotates while sliding on engaging hole portion 66, and operating shaft 71 tilts. At this time, a slight pressing force is also applied to press switch part 51 provided under operating shaft 71. However, when press switch part 51 is formed of dome-shaped movable contact 51B that has an inverting operation force inoperable by the slight pressing force, the failure caused by the force can be prevented. Further, when the edge of the portion at the lowermost end of operating shaft 71 in contact with press switch part 51 is formed into a curved, rounded surface, the pressing force to the press switch is further reduced. Such a structure is preferable.

Simultaneously with the tilting operation of operating shaft 71, driver 81 flexes coil spring 85 in the direction in which the coil spring is to be bent, while the driver is tilting in that direction. With the movement of driver 81, operating button 31E of one of horizontal push switches 31 disposed in the tilting direction is pressed by the corresponding portion of pressing part 82 formed of a circular ring shape. Thus, the multi-directional input device is brought into the tiling state of FIG. 20. Preferably, the angle at which operating shaft 71 is tilted is controlled by the structure in which the contact of operating shaft 71 with the end face of noncircular center hole 92 through metal cover 91 stops operating shaft 71. In the above tilting state of operating shaft 71, fixed contacts 31B of horizontal push switch 31 disposed in the tilting direction are electrically connected via movable contact 31C. Thus, electrical continuity is established between the pair of terminals 31F. When the above tilting force is removed thereafter, movable contact 31C self-restores to return horizontal push switch 31 to the original off-state and to push back pressing part 82 of driver 81. Further, the restoring force of coil spring 85 added to the above restoring force returns driver 81 and operating shaft 71 to the neutral state of FIG. 1.

In the above tilting operation and operation of returning therefrom, both top portion of driver 81 and top face part 93 of metal cover 91 in contact with the top portion are shaped into a gentle sphere, and brought into contact with each other. This structure provides a smooth operating state. Metal cover 91 forms a fixed exterior for controlling the position of driver 81. The contact between this fixed exterior and the moving driver made on both spherical surfaces prevents concentration of the stress and makes the movement smooth and less abrasive. The contact in the engaging portion between operating shaft 71 and rotating body 61 made on both curved surfaces including smooth arcs also contributes to the above smooth operating state.

Figure 21:
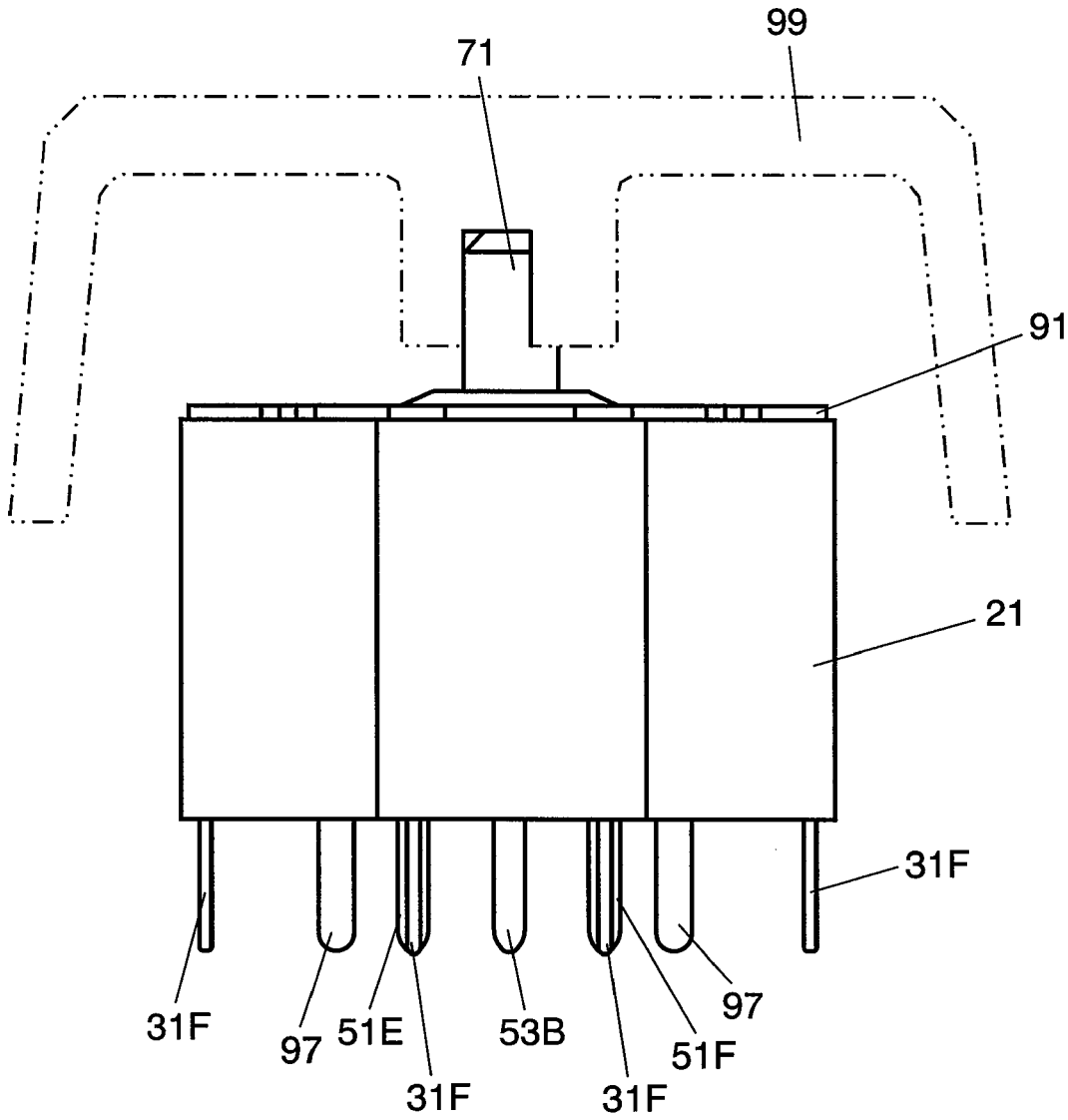
FIG. 21 is a side view of the multi-directional input device with a control knob attached thereto.

As described above, a multi-directional input device of this exemplary embodiment can be implemented as a device in which operating shaft 71 can be rotated, pressed downwardly, and tilted. FIG. 21 is a sectional view of the multi-directional input device with a control knob attached thereto. When the multi-directional input device is used, one control knob 99 is attached to operating shaft 71 as shown in FIG. 21. Then, the multi-directional input device can be mounted on actual equipment so that each of the above operations can be performed via control knob 99.

For the multi-directional input device structured as above, contact substrate 41 is incorporated in the bottom position of case part 21. Thus, the multi-directional input device can be mounted on the wiring board of the above equipment with the bottom face of contact substrate 41 brought directly into contact with the top face of the wiring board, and the pressing force can be born by the wiring board during the pressing operation of operating shaft 71. With this structure, even repeated pressing operations cause no place to have large play. Thus, unlike the conventional device, an excellent operating state can be maintained.

Further, in the normal state, operating shaft 71 is urged upwardly by the urging force of press switch part 51 so that polygonal sphere portion 73 is engaged to the inner wall of engaging hole portion 66. Thus, even when repeated tilting operations cause abrasion in the engaging portion between polygonal sphere portion 73 and the inner wall of engaging hole portion 66, the above urging force can prevent the rattle of operating shaft 71. As a result, an excellent titling state can be maintained for an extended period of time, also in the tilting operation.

For case part 21, a molded article integrating cylindrical holder 24 therein is used. This structure can eliminate the number of components. Further, switch mounting parts 25 are also integrated into case part 21 so that the respective components operable by rotating, pressing, and tilting operation can be accurately positioned and housed in the area defined by case part 21 and metal cover 91. Thus, in production, the above respective components are simply incorporated into case part 21 from the vertical direction thereof. With this structure, the production man-hours can be reduced, and respective components can be positioned and combined at high dimensional accuracy.

Further, the conventional structure requires a space in which upper substrate 5 rocks and moves upwardly in the tilting operation. However, the structure of the present invention does not require such a space and only the area defined by case part 21 and metal cover 91 need be ensured. Also at this point, the structure of the present invention is more convenient for the equipment.

As described above, the multi-directional input device of the present invention can provide predetermined output according to each of the rotating, pressing, tilting operations of one control knob 99. Further, in the multi-directional input device of the present invention, even an extended period of each operation causes little play or rattle and an excellent operating state can be maintained.

Figure 22:
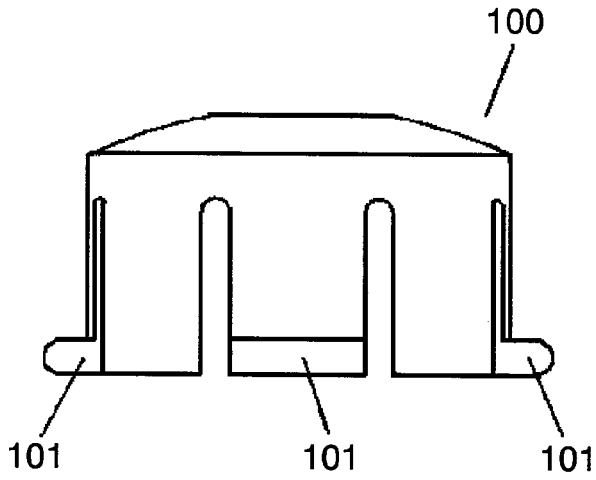
FIG. 22 is a side view of the driver formed into another shape.
Figure 23:
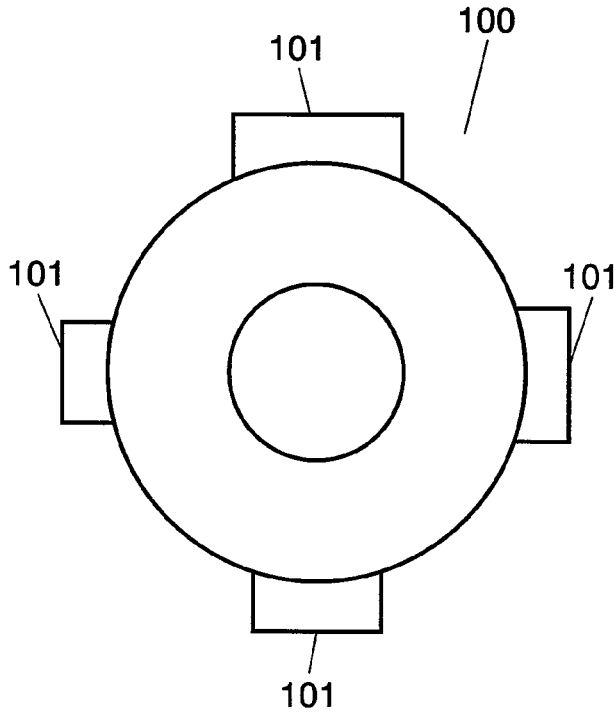
FIG. 23 is a top view of the driver formed into another shape.
Figure 24:
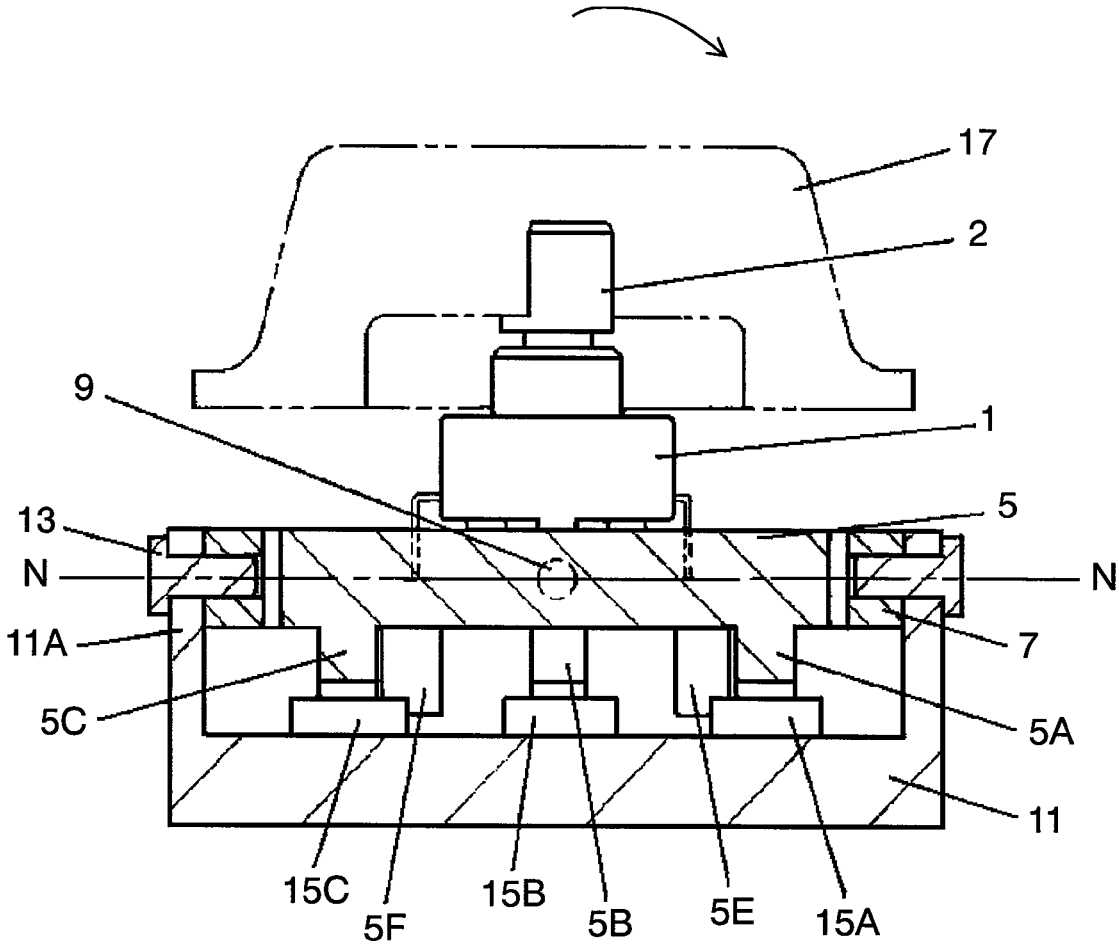
FIG. 24 PRIOR ART
FIG. 24 is a sectional view of a conventional multi-directional input device.
Figure 25:
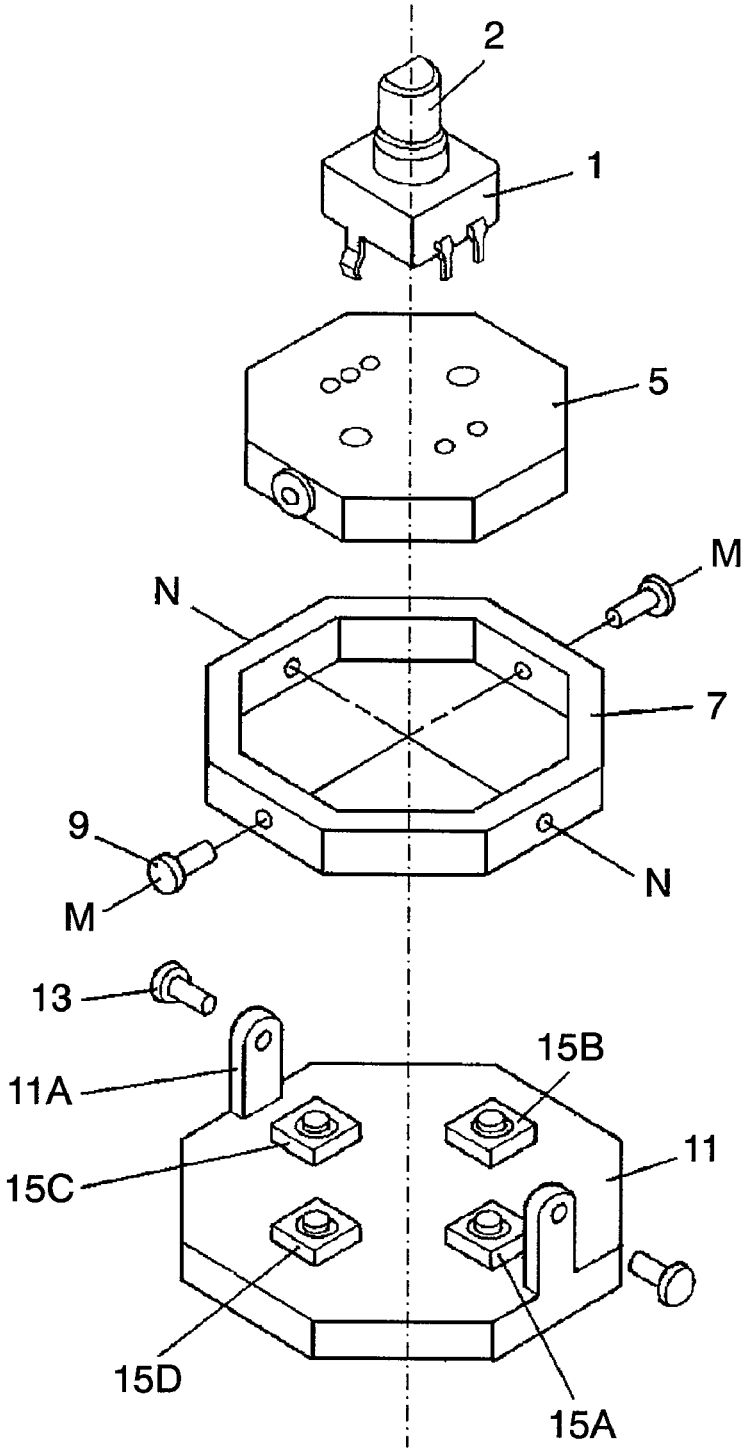
FIG. 25 PRIOR ART
FIG. 25 is an exploded perspective view of the conventional multi-directional input device.
Figure 26:
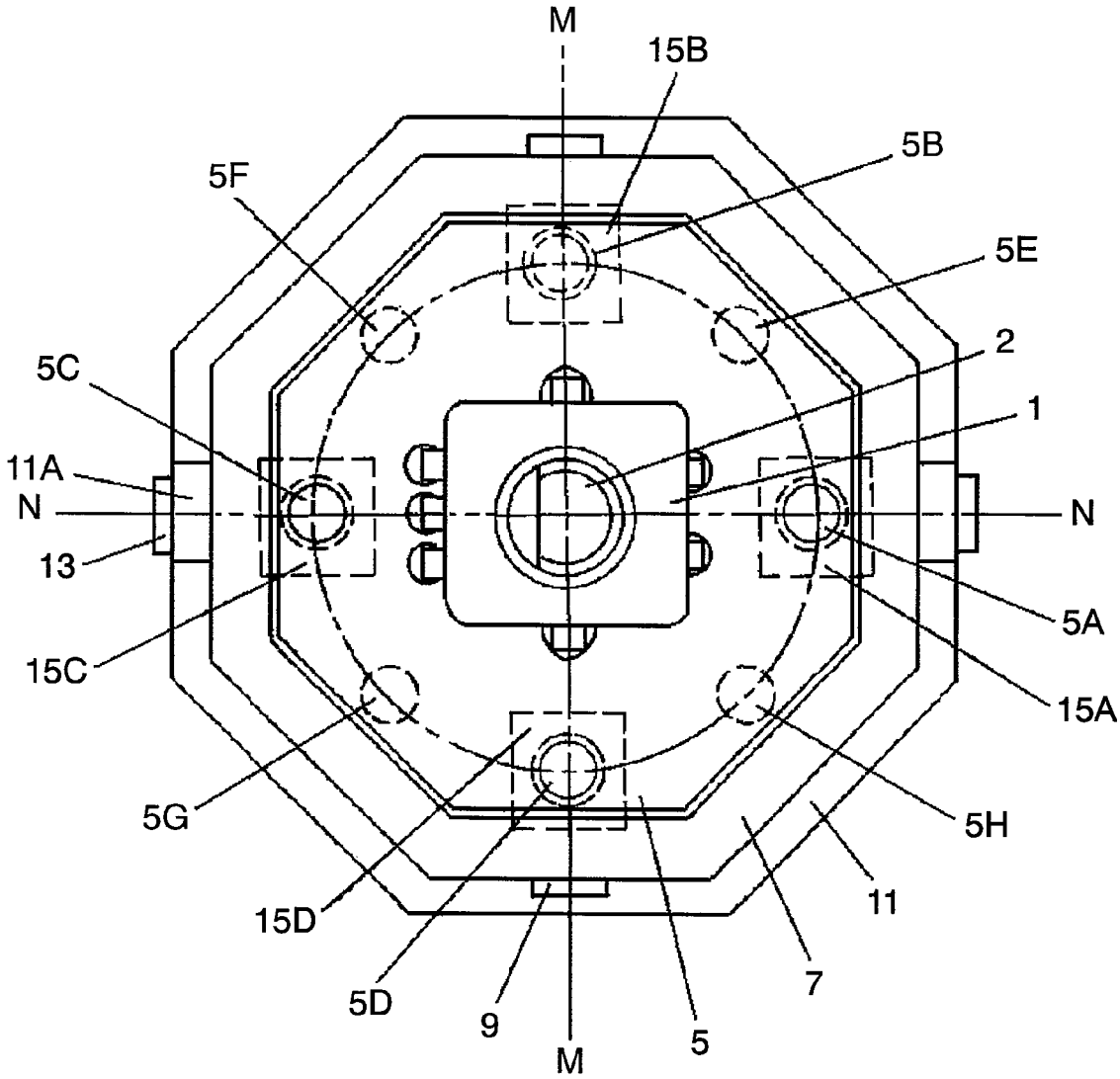
FIG. 26 PRIOR ART
FIG. 26 is a top view of the conventional multi-directional input device.

In the above description, driver 81 includes pressing part 82 having a circular ring shape as seen from the top, in the lower position of the skirt part. However, another shape can be used. FIG. 22 is a side view of a driver formed into another shape. FIG. 23 is a top view thereof. For example, the tip of each pressing part 101 of driver 100 may have a pressing surface made of a flat surface in surface contact with the front surface of operating button 31E of corresponding horizontal push switch 31. A structure in which pressing part 101 is brought into surface contact with the tip surface of operating button 31E of corresponding horizontal push switch 31 can further stabilize the operating state of horizontal push switch 31 in the tilting operation of operating shaft 71.

Further, the use of driver 100 can securely prevent inadvertent rotation of driver 100 and frictional contact thereof with operating buttons 31E of horizontal push switches 31 in the rotating operation of operating shaft 71. Thus, an excellent rotating feel can be provided. Driver 100 is directional, and the mounting direction is determined as described above. For this reason, as shown in FIG. 22, slits can be formed in the skirt part from the bottom side thereof to provide an arm shape having a certain resilience, and pressing parts 101 can be provided to protrude in the lateral direction in the lower position of the arm shape. This structure can provide a tilting angle including the deflection of the above arm-shaped portions.

In this exemplary embodiment, coil spring 85 is used to urge driver 81 upwardly. However, any resilient body can serve the same function.

In the exemplary embodiment, a description is provided of a structure in which the rotational encoder is operable by the rotating operation of operating shaft 71. However, the present invention is not limited to the above structure including the rotational encoder. A structure in which a variable resistor or rotary switch in place of the rotational encoder is operable by the rotating operation can be used. Further, the structures of press switch part 51 and horizontal push switch 31 are not limited to the above.

INDUSTRIAL APPLICABILITY

A multi-directional input device of the present invention is characterized in that even an extended period of each operation causes little play or rattle and an excellent operating state can be maintained. Thus, the multi-directional input device is useful in forming an input operation part or the like in various kinds of electronic equipment.

The invention claimed is:

1. A multi-directional input device comprising:

an operating shaft configured to rotate around a central axis thereof and to tilt in multiple directions from the central axis, the operating shaft including a cylindrical portion and polygonal sphere portion;

a rotating body rotating together with the operating shaft and sequentially connects or disconnects a slide contact and a fixed contact by rotation; and a plurality of horizontal push switches that are disposed around the operating shaft with the central axis as a center thereof and operable by tilting the operating shaft, wherein an outer surface of the polygonal sphere portion and an inner surface of the rotating body engage with each other when the operating shaft is tilted, have arc-shaped cross-sections parallel to the central axis of the operating shaft and noncircular cross-sections perpendicular to the central axis.

2. The multi-directional input device of claim 1, wherein the noncircular cross-section is a regular polygon.

3. The multi-directional input device of claim 1, wherein the noncircular cross-section is a regular hexagon.

4. The multi-directional input device of claim 1, wherein the operating shaft is pressed along the central axis to operate a press switch part provided under the operating shaft.

5. The multi-directional input device of claim 1, wherein the operating shaft includes a driver having a center hole for fitting to the cylindrical portion of the operating shaft is provided, and the horizontal push switches are operable by pressing operation of the driver caused by tilting of the operating shaft.

6. The multi-directional input device of claim 5, wherein the driver is urged upwardly with respect to the central axis by a resilient body.

7. The multi-directional input device of claim 6, wherein a surface of the upwardly urged driver in contact with a fixed exterior forms a part of a spherical surface.

8. The multi-directional input device of claim 1, wherein the rotating body includes an upper circular portion centered on the central axis, along an outer periphery of the rotating body, and the multi-directional input device further comprises an integrally molded case including a portion for fitting onto the upper circular portion and a portion for housing the horizontal push switches.

9. The multi-directional input device of claim 7, further comprising:

a contact substrate including the fixed contact; and a metal cover that is in contact with the driver and fixes the case and the contact substrate together by caulking, as the fixed exterior.

10. The multi-directional input device of claim 5, wherein a tip of a pressing part of the driver for pressing each of the horizontal push switches is formed of a flat surface.

11. The multi-directional input device of claim 10, wherein the driver includes a skirt part, and the pressing part laterally protruding at an edge portion of the skirt part, and the skirt part has a slit from a bottom side thereof to provide an arm shape having a certain resilience.

* * * * *

UNITED STATES PATENT AND TRADEMARK OFFICE

CERTIFICATE OF CORRECTION

PATENT NO. : 7,507,919 B2
APPLICATION NO. : 12/099336
DATED : March 24, 2009
INVENTOR(S) : Jun Sugahara et al.

It is certified that error appears in the above-identified patent and that said Letters Patent is hereby corrected as shown below:

On the Cover Page, please add FIELD [30], Foreign Application Priority Data,

"April 10, 2007 (JP) 2007-102432"

Signed and Sealed this

Eleventh Day of May, 2010

David J. Kappos

David J. Kappos
*Director of the United States Patent and Trademark Office*